US008686707B2

(12) United States Patent
Kung et al.

(10) Patent No.: US 8,686,707 B2
(45) Date of Patent: Apr. 1, 2014

(54) VOLTAGE REGULATOR WITH POWER SAVING FUNCTION

(75) Inventors: Yu-Pao Kung, Hsinchu (TW); Chih-Ping Chen, Hsinchu County (TW)

(73) Assignee: SONIX Technology Co., Ltd., Hsinchu (TW)

( * ) Notice: Subject to any disclaimer, the term of this patent is extended or adjusted under 35 U.S.C. 154(b) by 174 days.

(21) Appl. No.: 13/297,279

(22) Filed: Nov. 16, 2011

(65) Prior Publication Data

US 2013/0049724 A1 Feb. 28, 2013

(30) Foreign Application Priority Data

Aug. 22, 2011 (TW) ..... 100129970 A

(51) Int. Cl.
*G05F 3/04* (2006.01)
*G05F 1/00* (2006.01)

(52) U.S. Cl.
USPC ..... 323/312; 323/283

(58) Field of Classification Search
USPC ..... 323/282, 283, 312, 313
See application file for complete search history.

(56) References Cited

U.S. PATENT DOCUMENTS

| | | | | |
|---|---|---|---|---|
| 4,806,842 | A * | 2/1989 | Bittner | 323/222 |
| 6,617,928 | B2 * | 9/2003 | Finlay et al. | 330/288 |
| 7,106,034 | B2 | 9/2006 | Chien et al. | |
| 7,567,063 | B1 * | 7/2009 | Suzuki et al. | 320/166 |
| 2009/0206807 | A1 * | 8/2009 | Imura et al. | 323/277 |

* cited by examiner

*Primary Examiner* — Adolf Berhane
*Assistant Examiner* — Emily P Pham
(74) *Attorney, Agent, or Firm* — Jianq Chyun IP Office

(57) ABSTRACT

A voltage regulator with a low quiescent current is provided. The voltage regulator includes a pulse voltage generating unit, a first switch unit, a regulating unit and a power output unit. The pulse voltage generating unit receives an input voltage to provide an intermittent signal with a predetermined period, and output a pulse voltage according to the intermittent signal. The first switch unit is turned on according to the intermittent signal. The regulating unit converts the pulse voltage into a continuous voltage. The power output unit receives the continuous voltage to output a voltage power through a power output terminal. And, the power output unit detects an output current of the power output terminal to adjust current drive capability of the power output unit dynamically. Thus, the pulse voltage generating unit consumes power while the intermittent signal is enabled, so as to achieve the power saving effect.

10 Claims, 3 Drawing Sheets

VOLTAGE REGULATOR WITH POWER SAVING FUNCTION

CROSS-REFERENCE TO RELATED APPLICATION

This application claims the priority benefit of Taiwan application serial no. 100129970, filed on Aug. 22, 2011. The entirety of the above-mentioned patent application is hereby incorporated by reference herein and made a part of this specification.

BACKGROUND OF THE INVENTION

1. Field of the Invention

The invention relates to a voltage regulator. Particularly, the invention relates to a voltage regulator with a power-saving function and a low quiescent current.

2. Description of Related Art

In today's various consumer electronic products, a demand for various power supplies to simultaneously output a plurality of power voltages is increased. The current power supply generally has one or a plurality of voltage regulating circuits for providing required output voltages. Therefore, besides accuracy of each of the output voltages is strictly required, power consumption of the voltage regulating circuits is also one of important design considerations of the power supply.

When a voltage regulating circuit is designed, a liner regulator is generally used to implement the voltage regulating circuit. However, the liner regulator generally provides only one output mode, so that a large amount of current is generally consumed. Power consumptions of such type of the voltage regulating circuits are the same regardless of the power consumed by instantaneous loads. Namely, a quiescent current consumed by the linear regulator during operation is a fixed value. Therefore, when an external load driven by the voltage regulating circuit requires a large output current, the voltage regulating circuit consumes the fixed quiescent current, and when the output current required by the external load is decreased, the quiescent current consumed by the voltage regulating circuit is still maintained fixed, so that extra energy is consumed.

It should be noticed that the greater an input voltage received by the linear regulator is, the lower the output current thereof has to be, so as to prevent damaging a power amplifier in the linear regulator. However, current driving capability of the linear regulator is accordingly limited, and demand of the external load having a lighter or heavier variation cannot be satisfied.

SUMMARY OF THE INVENTION

The invention is directed to a voltage regulator with a low quiescent current, which consumes relatively less power to maintain a continuous voltage, and dynamically adjusts current driving capability of a power output unit according to an output current, so as to reduce consumption of the quiescent current to save power.

The invention provides a voltage regulator including a pulse voltage generating unit, a first switch unit, a regulating unit and a power output unit. The pulse voltage generating unit receives an input voltage to generate an intermittent signal with a predetermined period, and output a pulse voltage according to the intermittent signal. The first switch unit is coupled to the pulse voltage generating unit, and a first terminal and a control terminal of the first switch unit respectively receive the pulse voltage and the intermittent signal.

Therefore, the first switch unit conducts the first terminal and a second terminal thereof according to the intermittent signal. The regulating unit is coupled to the second terminal of the first switch unit, and converts the pulse voltage to a continuous voltage. The power output unit is coupled to the first switch unit and the regulating unit, and receives the continuous voltage to output a voltage power through a power output terminal, where the power output unit detects an output current of the power output terminal to dynamically adjust current driving capability of the power output unit.

In an embodiment of the invention, the pulse voltage generating unit includes an intermittent signal generating module, a reference voltage generator and a voltage conversion module. The intermittent signal generating module receives the input voltage to periodically generate the intermittent signal. The reference voltage generator is coupled to the intermittent signal generating module, and generates a reference voltage according to the input voltage when the intermittent signal is enabled. The voltage conversion module is coupled to the intermittent signal generating module and the reference voltage generator, and converts the reference voltage to output the pulse voltage when the intermittent signal is enabled, where a voltage level of the reference voltage is different to a voltage level of the pulse voltage in an enable state.

In an embodiment of the invention, the reference voltage generator can be a bandgap reference circuit. The voltage conversion module includes a first amplifier, a first resistor and a second resistor. A first input terminal of the first amplifier receives the reference voltage, a control terminal of the first amplifier receives the intermittent signal, and an output terminal of the first amplifier outputs the pulse voltage. The first amplifier operates only when the intermittent signal is enabled. The first resistor and the second resistor divide the pulse voltage into a feedback voltage, and transmit the feedback voltage to a second input terminal of the first amplifier.

In an embodiment of the invention, the power output unit includes a second amplifier, a second switch unit and a current sensing module. A first input terminal of the second amplifier receives the continuous voltage. A control terminal of the second switch unit is coupled to an output terminal of the second amplifier, a first terminal of the second switch unit receives the input voltage, and the first terminal of the second switch unit is the power output terminal. The current sensing module is coupled between the second amplifier and the power output terminal. The current sensing module detects the output current of the power output terminal to dynamically adjust current driving capability of the second amplifier, so that the output current is enough to drive an external load coupled to the power output terminal.

According to the above descriptions, the voltage regulator of the invention uses an enable state of the intermittent signal and the regulating unit to maintain a voltage level of the continuous voltage, and continually uses the current sensing module to detect the output current of the power output terminal to dynamically adjust the current driving capability of the power output unit, so as to reduce the quiescent current consumed during the operation of the voltage regulator. In this way, while the voltage regulator of the invention can output an accurate voltage power, it also has low power consumption.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
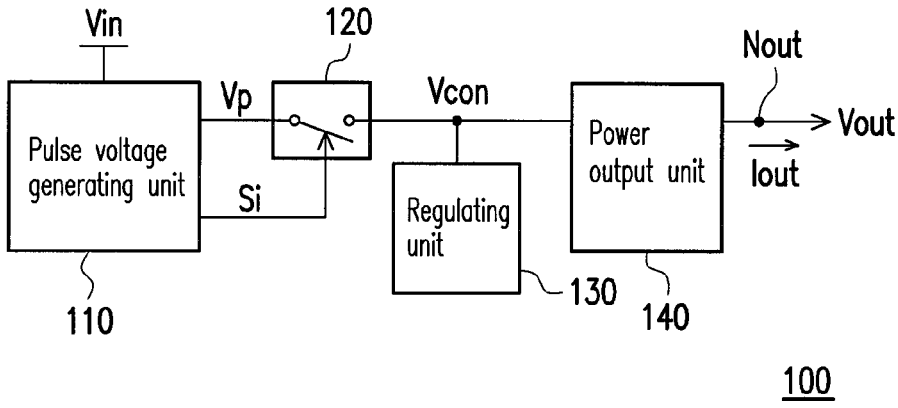
FIG. 1 is a functional block diagram of a voltage regulator according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

In order to achieve an effect that a voltage regulating circuit in a power supply consumes less quiescent current during operation, an embodiment of the invention provides a voltage regulator 100, which consumes less power to maintain a voltage level of a continuous voltage Vcon, and continually detects an output current of a power output terminal to dynamically adjust current driving capability of the power regulator 100. In this way, while good accuracy of the output voltage is achieved, the quiescent current consumed by the voltage regulator 100 is also saved. Embodiments are provided below to describe the concept of the invention in detail.

FIG. 1 is a functional block diagram of a voltage regulator 100 according to an embodiment of the invention. Referring to FIG. 1, the voltage regulator 100 is adapted to an electronic apparatus having a power supply, where the power supply may have one or a plurality of voltage regulators 100 to provide corresponding voltage powers according to required voltage levels. The voltage regulator 100 of FIG. 1 is taken as an example for descriptions.

The voltage regulator 100 regulates an input voltage Vin and converts it into a voltage power (for example, an output voltage Vout and an output current Iout), so as to drive an external load coupled to a power output terminal Nout. In the present embodiment, the voltage regulator 100 regulates an input voltage Vin of 5V and converts it into an output voltage Vout of 3.3V. However, the invention is not limited to the aforementioned voltage levels, and those skilled in the art can adjust voltage levels or regulates voltage ranges of the input voltage Vin, the output voltage Vout, a reference voltage Vref, a pulse voltage Vp, and a continuous voltage Vcon, etc. according to an actual design requirement.

Referring to FIG. 1, the voltage regulator 100 includes a pulse voltage generating unit 110, a first switch unit 120, a regulating unit 130 and a power output unit 140. The pulse voltage generating unit 110 receives the input voltage Vin to generate an intermittent signal Si with a predetermined period. Moreover, the pulse voltage generating unit 110 outputs a pulse voltage Vp according to the intermittent signal Si.

The first switch unit 120 is coupled to the pulse voltage generating unit 110, the regulating unit 130 and the power output unit 140. A first terminal and a control terminal of the first switch unit 120 respectively receive the pulse voltage Vp and the intermittent signal Si, and a second terminal of the first switch unit 120 is electrically connected to the regulating unit 130 and an input terminal of the power output unit 140 for providing a continuous voltage Vcon. Therefore, the first switch unit 120 can conduct the first terminal and the second terminal thereof according to whether the intermittent signal Si is enabled.

Referring to FIG. 1, the regulating unit 130 converts the pulse voltage Vp into the continuous voltage Vcon when the first switch unit 120 is turned on, and when the first switch unit 120 is turned off, the regulating unit 130 maintains a voltage level of the continuous voltage Vcon. On the other hand, the power output unit 140 receives the continuous voltage Vcon through the input terminal thereof to output a voltage power through the power output terminal Nout.

It should be noticed that the power output unit 140 continually detects the output current Iout of the power output terminal Nout to dynamically adjust current driving capability of the power output unit 140. In other words, when the power output unit 140 detects that an external load coupled to the power output terminal Nout requires a large output current Iout, the power output unit 140 increases its current driving capability, by which although more quiescent current is consumed, the external load can be successfully driven. On the other hand, when the power output unit 140 detects that the external load requires a small output current Iout, the power output unit 140 decreases its current driving capability, so as to reduce consumption of the quiescent current.

Figure 2:
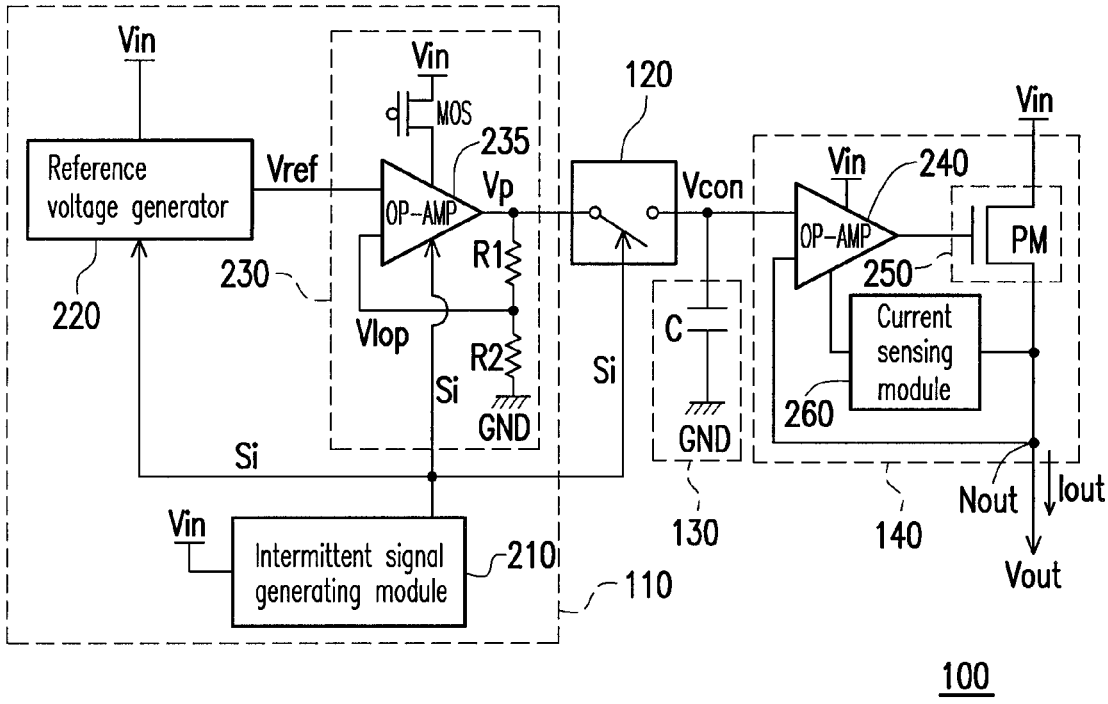
FIG. 2 is a block circuit diagram of a voltage regulator according to an embodiment of the invention.

Actuation methods and circuit structures of the various functional blocks in the voltage regulator 100 are described in detail below. FIG. 2 is a block circuit diagram of the voltage regulator 100 according to an embodiment of the invention. Referring to FIG. 2, the pulse voltage generating unit 110 includes an intermittent signal generating module 210, a reference voltage generator 220 and a voltage conversion module 230. The intermittent signal generating module 210 receives the input voltage Vin to periodically generate the intermittent signal Si.

Figure 3:
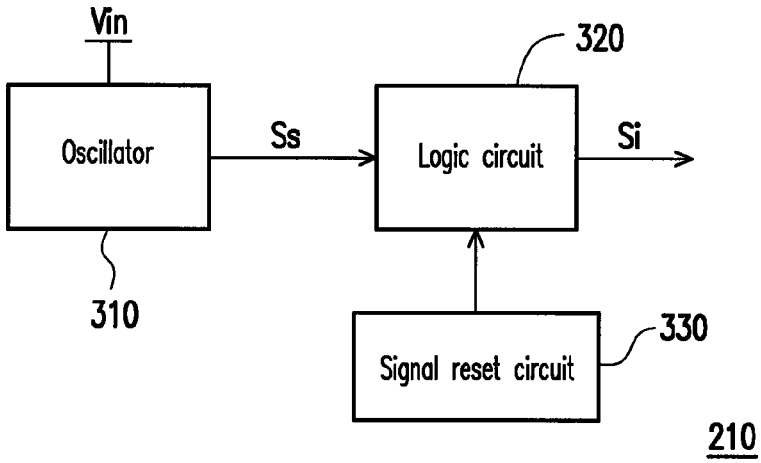
FIG. 3 is a functional block diagram of an intermittent signal generating module of FIG. 2.
Figure 4:
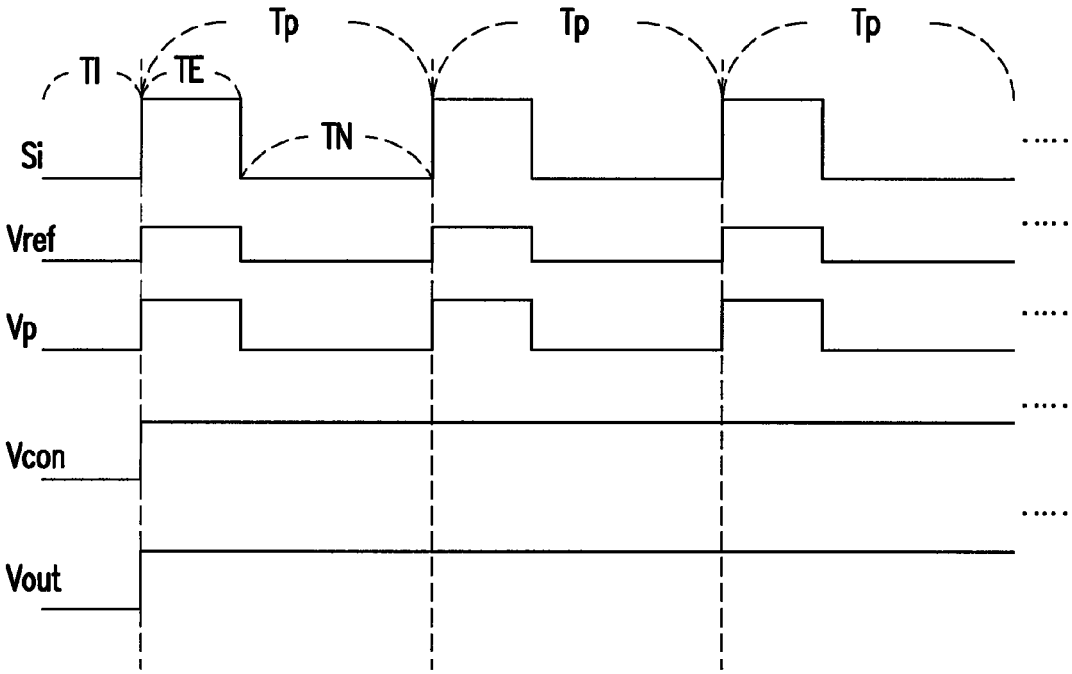
FIG. 4 is a timing diagram of an intermittent signal, a reference voltage, a pulse voltage, a continuous voltage and an output voltage in the voltage regulator.

The structure of the intermittent signal generating module 210 is described below. FIG. 3 is a functional block diagram of the intermittent signal generating module 210 of FIG. 2, and FIG. 4 is a timing diagram of the intermittent signal Si, the reference voltage Vref, the pulse voltage Vp, the continuous voltage Vcon and the output voltage Vout in the voltage regulator 100. Referring to FIG. 3, the intermittent signal generating module 210 includes an oscillator 310 and a logic circuit 320.

The oscillator 310 receives the input voltage Vin to generate an oscillation signal Ss. The logic circuit 320 is coupled to the oscillator 310, and converts the oscillation signal Ss into the intermittent signal Si according to a predetermined period Tp and an enable period TE (shown in FIG. 4), where a disable period TN is obtained according to the predetermined period Tp and the enable period TE. In other words, the intermittent signal Si is generated by the intermittent signal generating module 210 according to the predetermined period Tp and the enable period TE. Therefore, the intermittent signal Si is periodically enabled in the enable periods TE. According to the above descriptions, the oscillation signal Ss should have a relatively high output frequency, or a clock cycle of the oscillation signal Ss can be proportional to parameters of the predetermined period Tp and the enable period TE of the intermittent signal Si, and generation details of the intermittent signal Si are not described herein.

In FIG. 4, a period T1 represents a reset period that the voltage regulator 100 just starts to receive the input voltage Vin for operation. In some embodiments, when the voltage regulator 100 just starts to receive the input voltage Vin (for example, the reset period T1), many signals are still unknown during the reset period T1. Therefore, to avoid an unknown error, the intermittent signal generating module 210 further includes a signal reset circuit 330 for resetting the signals and voltages to predetermined states thereof in the reset period T1. For example, the signal reset circuit 330 resets the intermittent signal S1 to a disable state in the reset period T1.

Referring to FIG. 2 and FIG. 4, the reference voltage generator 220 is coupled to the intermittent signal generating module 210, and receives the intermittent signal Si and generates the reference voltage Vref according to the input voltage Vin when the intermittent signal Si is in the enable period TE, so that the reference voltage Vref is periodically provided to the voltage conversion module 230. In the present embodiment, the reference voltage generator 220 can be a bandgap reference circuit, and a voltage level of the reference voltage Vref can be 1.2V, and as described above, the voltage level of the reference voltage Vref is not limited thereto.

The voltage conversion module 230 is coupled to the intermittent signal generating module 210 and the reference voltage generator 220, and converts the reference voltage Vref into the pulse voltage Vp when the intermittent signal Si is enabled. Here, the circuit structure of the voltage conversion module 230 is described in detail. The voltage conversion module 230 includes a first amplifier 235, a first resistor R1 and a second resistor R2. The first amplifier 235 can be implemented by a power amplifier of an active device, or implemented by other circuit devices with the same function, which is not limited by the invention. A power terminal of the first amplifier 235 receives the input voltage Vin through a first transistor (for example, a P-type transistor MOS), a first input terminal of the first amplifier 235 can be regarded as an input terminal of the voltage conversion module 230 and receives the reference voltage Vref. A control terminal of the first amplifier 235 receives the intermittent signal Si, and an output terminal of the first amplifier 235 outputs the pulse voltage Vp.

In the present embodiment, the P-type transistor MOS of the first amplifier 235 can bias the input voltage Vin to generate a driving voltage suitable for the first amplifier 235. The P-type transistor MOS can also be controlled by an external signal to determine whether or not to transmit the input voltage Vin to the first amplifier 235, so as to control the operation of the first amplifier 235. In other embodiment, the P-type transistor MOS can also be included in the first amplifier 235, and also has the aforementioned bias function and the function of controlling transmission of the input voltage Vin, and those skilled in the art can determine how to allocate the P-type transistor MOS according to the circuit structure of the first amplifier 235, which is not limited by the invention.

A first end of the first resistor R1 is coupled to the output terminal of the first amplifier 235, and a second end of the first resistor R1 and a first end of the second resistor R2 are all coupled to a second input terminal of the first amplifier 235 (which can also be referred to as a feedback input terminal of the first amplifier 235). A second end of the second resistor R2 is coupled to ground GND. In this way, the first resistor R1 and the second resistor R2 divide the pulse voltage Vp into a feedback voltage Vlop, and transmit the feedback voltage Vlop to the feedback input terminal of the first amplifier 235.

It should be noticed that since the control terminal of the first amplifier 235 receives the intermittent signal Si, the first amplifier 235 normally operates only when the intermittent signal Si is enabled. Therefore, referring to FIG. 4, the first amplifier 235 converts the 1.2V reference voltage Vref into the 3.3V pulse voltage Vp during the enable period TE of the intermittent signal Si. Moreover, the voltage level (for example, 1.2V) of the reference voltage Vref is different to the voltage level (for example, 3.3V) of the pulse voltage Vp in the enable state.

The first switch unit 120 conducts the two terminals thereof when the intermittent signal Si is enabled, so that the voltage level of the pulse signal Vp is equivalent to the voltage level of the continuous voltage Vcon. When the intermittent signal Si is disabled (i.e. in the disable period TN of the intermittent signal Si), the regulating unit 130 maintains the voltage level of the continuous voltage Vcon. In the present embodiment, a regulating capacitor C is used to implement the regulating unit 130, where a first end of the regulating capacitor C receives the continuous voltage Vcon, and a second end thereof is coupled to the ground GND. In this way, after each predetermined period Tp, the first switch unit 120 is turned on to equalize the voltage level of the continuous voltage Vcon to the voltage level of the pulse voltage Vp in the enable state, so as to maintain the voltage level (for example, 3.3V) of the output voltage Vout.

A detailed structure of the power output unit 140 is described below. As shown in FIG. 2, the power output unit 140 includes a second amplifier 240, a second switch unit 250 and a current sensing module 260. Similar to the first amplifier 235, the second amplifier can also be implemented by a power amplifier (OP-AMP), and the second switch unit 250 can be implemented by an N-type MOS transistor. A first input terminal of the second amplifier 240 serves as the input terminal of the power output unit 140 to receive the continuous voltage Vcon. A second input terminal (which can also be referred to as a feedback input terminal) of the second amplifier 240 is coupled to the power output terminal Nout to stably provide the output voltage Vout of the voltage power, and stabilize the voltage level of the output voltage Vout to the voltage level of the continuous voltage Vcon.

The current sensing module 260 is coupled between the second amplifier 240 and the power output terminal Nout of the voltage regulator 100. Thus, the current sensing module 260 can detect the output current Iout of the power output terminal Nout to dynamically adjust current driving capability of the second amplifier 240, so that the output current Tout can be enough to drive the external load coupled to the power output terminal Nout.

Therefore, compared to the conventional linear regulator, in the present embodiment, two methods are simultaneously used to reduce the quiescent current consumed during operation of the voltage regulator 100. The first method is to use the enable state of the intermittent signal Si and the regulating unit 130 (the regulating capacitor C) to maintain the voltage level of the continuous voltage Vcon. Since the intermittent signal Si is periodically enabled, the quiescent current consumed by the reference voltage generator 220 and the voltage conversion module 230 during the disable period TN of the intermittent signal Si is saved.

The second method is to continually use the current sensing module 260 of the power output unit 140 to detect the output current Iout of the power output terminal Nout to dynamically adjust the current driving capability of the second amplifier 240 of the power output unit 140, so as to save the quiescent current when the external load has a light load. On the other hand, when the external load has a heavy load, the second method can also dynamically adjust the current driving capability of the second amplifier 240, so as to increase an application range of the voltage regulator 100. Moreover, the first amplifier 235 in the voltage conversion module 230 is specifically used for voltage conversion and is none related to driving of the external load.

Figure 5:
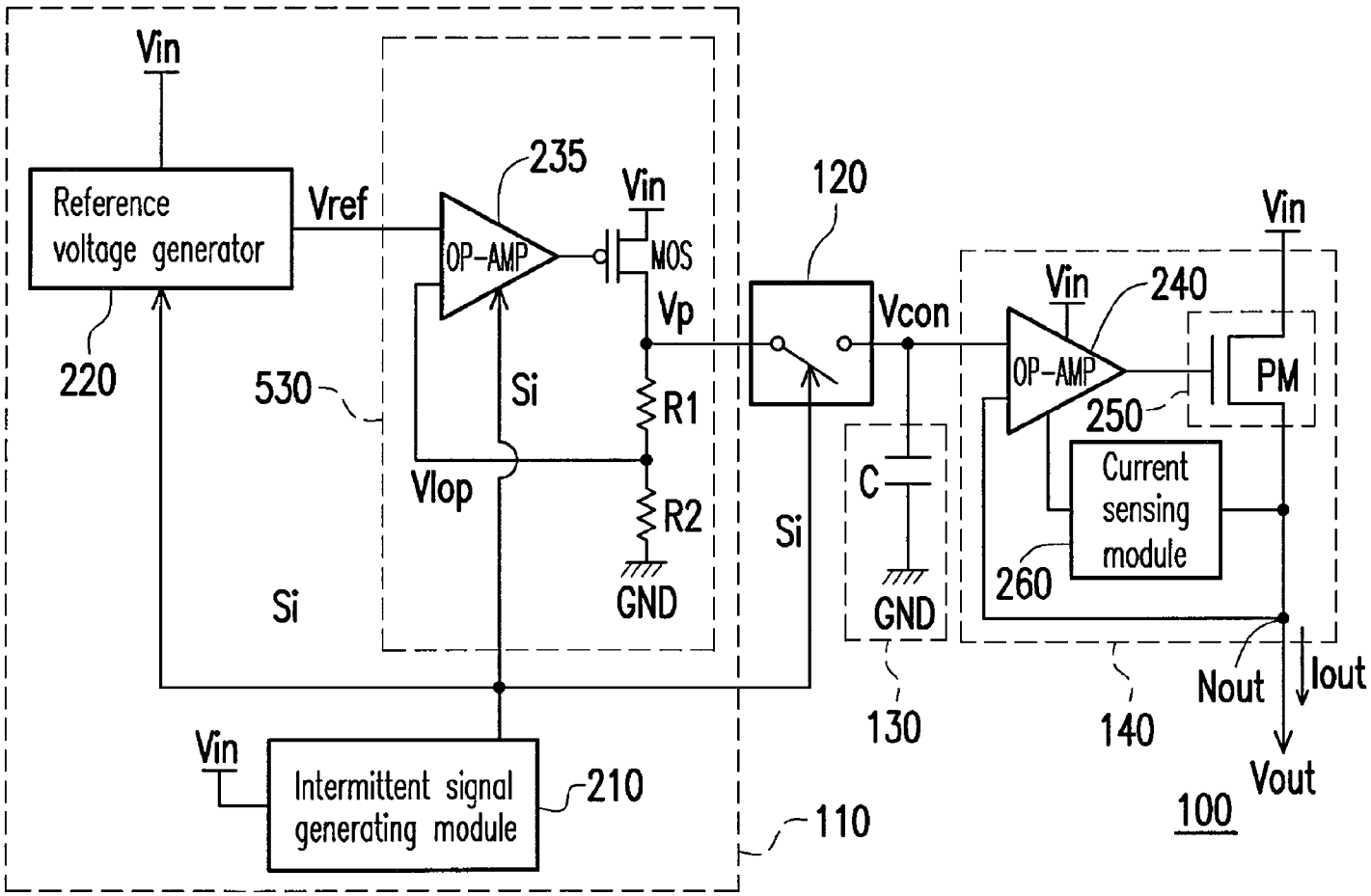
FIG. 5 is a block circuit diagram of a voltage regulator according to another embodiment of the invention.

FIG. 5 is a block circuit diagram of a voltage regulator according to another embodiment of the invention. The embodiment of FIG. 5 is similar to the above embodiment, and the similar part won't be described herein. The difference between the embodiment of FIG. 5 and the embodiment of FIG. 2 is the circuit structure of the voltage conversion module 530 of FIG. 5. The voltage conversion module 530 includes a first amplifier 235, a first transistor (for example, a P-type transistor MOS), a first resistor R1 and a second resistor R2. The first transistor MOS is coupled between the first end of the first resistor R1 and the output terminal of the first amplifier 235. In other words, the first transistor MOS has a control terminal coupled to the output terminal of the first amplifier, a first terminal receiving the input voltage, and a second terminal coupled to the first end of the first resistor. Thus, the first amplifier 235 controls the voltage level of one terminal of the first switch unit 120 through the first transistor MOS.

In summary, the voltage regulator 100 of the invention uses the enable state of the intermittent signal Si and the regulating unit 130 to maintain a voltage level of the continuous voltage Vcon, and continually uses the current sensing module 260 to detect the output current Iout of the power output terminal Nout to dynamically adjust the current driving capability of the amplifier in the power output unit 140, so as to reduce the quiescent current consumed during the operation of the voltage regulator 100. In this way, while the voltage regulator 100 of the invention can output an accurate voltage power, it also has low power consumption.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A voltage regulator, comprising:

a reference voltage generator;

a voltage conversion module, coupled to the reference voltage generator, and generating a pulse voltage;

a first switch unit, coupled to the voltage conversion module, and having a first terminal receiving the pulse voltage;

a regulating unit, coupled to a second terminal of the first switch unit, and converting the pulse voltage into a continuous voltage;

a power output unit, coupled to the first switch unit and the regulating unit, and receiving the continuous voltage to output a voltage power through a power output terminal; and an intermittent signal generating module, coupled to the reference voltage generator, the voltage conversion module and the first switch unit, and periodically generating an intermittent signal according to a predetermined period, wherein when the intermittent signal is enabled, the reference voltage generator generates a reference voltage according to an input voltage, the voltage conversion module converts the reference voltage to output the pulse voltage, and the first switch unit conducts the first terminal and the second terminal thereof.

2. The voltage regulator as claimed in claim 1, wherein the reference voltage generator is a bandgap reference circuit.

3. The voltage regulator as claimed in claim 1, wherein the intermittent signal generating module comprises:

an oscillator, generating an oscillation signal; and a logic circuit, coupled to the oscillator, and converting the oscillation signal into the intermittent signal according to the predetermined period.

4. The voltage regulator as claimed in claim 3, wherein the intermittent signal generating module further comprises:

a signal reset circuit, resetting the intermittent signal within a first period of receiving the input voltage.

5. The voltage regulator as claimed in claim 1, wherein the voltage conversion module comprises:

a first amplifier, having a first input terminal receiving the reference voltage, a control terminal receiving the intermittent signal, and an output terminal outputting the pulse voltage, wherein the first amplifier operates when the intermittent signal is enabled; and a first resistor and a second resistor, wherein a first end of the first resistor is couple to the output terminal of the first amplifier, a second end of the first resistor and a first end of the second resistor are coupled to a second input terminal of the first amplifier, and a second end of the second resistor is coupled to ground, wherein the first resistor and the second resistor divide the pulse voltage into a feedback voltage, and transmit the feedback voltage to the second input terminal of the first amplifier.

6. The voltage regulator as claimed in claim 5, wherein the voltage conversion module further comprises:

a first transistor, having a third terminal coupled to the first amplifier, and a fourth terminal receiving the input voltage.

7. The voltage regulator as claimed in claim 5, wherein the voltage conversion module further comprises:

a first transistor, coupled between the first end of the first resistor and the output terminal of the first amplifier, having a control terminal coupled to the output terminal of the first amplifier, a fifth terminal receiving the input voltage, and a sixth terminal coupled to the first end of the first resistor.

8. The voltage regulator as claimed in claim 1, wherein the power output unit comprises:

a second amplifier, having a first input terminal receiving the continuous voltage;

a second switch unit, having a control terminal coupled to an output terminal of the second amplifier, and a seventh terminal receiving the input voltage, wherein the seventh terminal of the second switch unit is the power output terminal; and a current sensing module, coupled between the second amplifier and the power output terminal, and detecting the output current of the power output terminal to dynamically adjust current driving capability of the second amplifier, so that the output current is enough to drive an external load coupled to the power output terminal.

9. The voltage regulator as claimed in claim 8, wherein the second switch unit comprises a power transistor.

10. The voltage regulator as claimed in claim 1, wherein the regulating unit comprises a regulating capacitor, and the regulating capacitor is coupled between the second terminal of the first switch unit and ground.

* * * * *